US010251817B2

(12) United States Patent
Roehrig

(10) Patent No.: US 10,251,817 B2
(45) Date of Patent: Apr. 9, 2019

(54) TEAT

(71) Applicant: BAMED AG, Wollerau (CH)

(72) Inventor: Peter Roehrig, Vienna (AT)

(73) Assignee: BAMED AG, Wollerau (CH)

( * ) Notice: Subject to any disclaimer, the term of this patent is extended or adjusted under 35 U.S.C. 154(b) by 0 days.

(21) Appl. No.: 15/637,786

(22) Filed: Jun. 29, 2017

(65) Prior Publication Data

US 2017/0296437 A1 Oct. 19, 2017

Related U.S. Application Data

(63) Continuation of application No. 10/828,118, filed on Apr. 20, 2004, now Pat. No. 9,724,272.

(30) Foreign Application Priority Data

Apr. 29, 2003 (AT) ..... GM 298/2003 U
Oct. 23, 2003 (AT) ..... GM 734/2003 U

(51) Int. Cl.
*A61J 11/00* (2006.01)
*A61J 11/02* (2006.01)
*A61J 11/04* (2006.01)

(52) U.S. Cl.
CPC ..... *A61J 11/005* (2013.01); *A61J 11/006* (2013.01); *A61J 11/0035* (2013.01); *A61J 11/0065* (2013.01); *A61J 11/02* (2013.01); *A61J 11/045* (2013.01)

(58) Field of Classification Search
CPC .... A61J 11/001; A61J 11/0035; A61J 11/005; A61J 17/00; A61J 17/001
USPC ..... 606/234–236; D24/194–198; 215/11.1–11.6
See application file for complete search history.

(56) References Cited

U.S. PATENT DOCUMENTS

| | | | | |
|---|---|---|---|---|
| 1,902,433 | A | 7/1931 | Brown | |
| 2,366,214 | A * | 1/1945 | Ramaker | A61J 11/00 215/11.1 |
| 2,388,915 | A * | 11/1945 | Heilborn | A61J 11/0035 215/11.1 |
| 2,517,457 | A | 8/1950 | Allen | |
| 3,825,014 | A | 7/1974 | Wroten | |
| 4,505,398 | A | 3/1985 | Kesserling | |
| 4,613,050 | A | 9/1986 | Atkin et al. | |
| 4,623,069 | A | 11/1986 | White | |
| 5,004,473 | A | 4/1991 | Kalantar | |
| 5,108,686 | A | 4/1992 | Griffin | |
| 5,544,766 | A | 8/1996 | Dunn et al. | |
| 5,938,053 | A | 8/1999 | Verbovszky | |
| 6,161,710 | A | 12/2000 | Dieringer et al. | |
| 6,241,110 | B1 | 6/2001 | Hakim | |

(Continued)

FOREIGN PATENT DOCUMENTS

| | | |
|---|---|---|
| AT | 408185 B | 9/2001 |
| DE | 466541 C | 7/1930 |

(Continued)

*Primary Examiner* — Katherine M Rodjom
(74) *Attorney, Agent, or Firm* — Greenblum & Bernstein, P.L.C.

(57) ABSTRACT

A teat including at least a shaft and a nipple, wherein structured surface areas are provided at least in a partial region thereof, and the structured surface areas are formed by at least one rough surface zone having a surface roughness of 100 μm at the most, or 50 μm at the most.

25 Claims, 5 Drawing Sheets

(56) References Cited

U.S. PATENT DOCUMENTS

| | | | | |
|---|---|---|---|---|
| 6,699,264 | B1 | 3/2004 | Roehrig | |
| 6,968,964 | B2 | 11/2005 | Gilmore | |
| 7,122,045 | B2 | 10/2006 | Randolph et al. | |
| 2003/0093120 | A1* | 5/2003 | Renz | A61J 11/0035 606/236 |
| 2003/0093121 | A1 | 5/2003 | Randolph | |
| 2003/0181947 | A1 | 9/2003 | Struckmeier et al. | |
| 2005/0035078 | A1 | 2/2005 | Lieberman et al. | |
| 2005/0277987 | A1 | 12/2005 | Randolph et al. | |

FOREIGN PATENT DOCUMENTS

| | | | |
|---|---|---|---|
| DE | 1886610 | U | 1/1964 |
| DE | 32 41 845 | A1 | 5/1984 |
| DE | 4418604 | A1 | 12/1994 |
| DE | 19716534 | A1 | 11/1997 |
| DE | 201 00 392 | U1 | 3/2001 |
| DE | 202 19 950 | U1 | 3/2003 |
| EP | 1 275 366 | A2 | 1/2003 |
| GB | 639628 | A | 7/1950 |
| GB | 968698 | A | 9/1964 |
| WO | WO-01/00136 | A1 | 1/2001 |

* cited by examiner

TEAT

CROSS-REFERENCE TO RELATED APPLICATIONS

This application is a continuation under 35 USC § 120 of nonprovisional U.S. patent application Ser. No. 10/828,118, filed Apr. 20, 2004, which claims the benefit under 35 USC § 119 of Austrian patent application GM 298/2003, filed Apr. 29, 2003, and Austrian patent application GM 734/2003, filed Oct. 23, 2003, the disclosures of all of the aforementioned applications being hereby incorporated by reference thereto in their entireties.

FIELD OF THE INVENTION

The invention relates to a teat comprising at least one shaft and a nipple, wherein structured surface areas are provided at least in a partial region thereof.

BACKGROUND

In known teats, structured surface areas are formed by thickened material portions, i.e., projections, or depressions, respectively, between the projections, wherein particularly ribs, nodules or also honeycomb-like structures are known, cf., e.g., U.S. Pat. No. 6,241,110-B1, DE 32 41 845-A1, U.S. Pat. No. 2,366,214-A and AT 408 185-B. Generally, these projections, or depressions, respectively, are provided around the teat, and they should be of help during teething, provide saliva-flow-channels or imitate a mother's breast so as to provide for a pleasant sucking sensation during drinking in case of feeding bottle teats for infants, cf. in this context also DE 466 541-C or also DE 197 16 534-A; in the latter one, particularly ledge-shaped or winding elevations have been described which each are preferably formed on a broadside of the cross-sectionally oval nipple of the teat.

However, the known teats imitate a mother's breast only very insufficiently, since the projections result in an excessive structuring so that a similarity with a mother's breast with a view to the surface structure is not really achieved. Moreover, the comparatively highly structured surface, in particular ribs, nodules and the like projections have the undesired effect of providing an excessive stiffening of the teat in the region in question. In practice, this has the consequence that particularly soft materials are used for producing the teat so as to compensate for the undesired stiffness, which in turn causes an insufficient strength of the teat in the remaining regions.

SUMMARY

It is an object of this invention to provide a teat of the type as defined above which provides as close an imitation of a mother's breast as possible while nevertheless guaranteeing the required strength or stiffness of the teat without having to put up with a regionally excessive strength and which, in particular, regionally resembles the skin as closely as possible.

According to the present invention, the teat has surface structures that are formed by at least one rough surface zone having a surface roughness of 100 μm at the most or, in particular, 50 μm at the most. By the roughness of the surface of the teat being in the range of several 10 μm, a soft, skin-like appearance is not only already optically conveyed, in these regions the teat also feels like skin, comparable to a mother's breast, and particularly soft. Tests have shown that it is particularly suitable if the rough surface zone has a surface roughness of from approximately 10 μm to 40 μm, preferably from 15 μm to 30 μm.

It is also advantageous if the rough surface zone is substantially triangular in perspective view. In this embodiment, the rough surface zone may triangularly extend towards the nipple or tip of the nipple, respectively, and when drinking, in case of a teat for a feeding bottle, or when sucking, in case of a teat for a pacifier, the tongue which then comes into contact with this surface resembling a mother's breast will be efficiently stimulated thereby. Accordingly, advantageously the rough surface zone extends at least partially into the nipple.

For reasons of hygiene it is, moreover, suitable if several rough surface zones are provided which are separated from one another by transparent zones. Through the transparent zones or regions, soiling etc, in the interior of the teat (feeding bottle teat or pacifier teat) can immediately be detected, even in the region on the inner side of the rough surface zones, just as well as any possible lumps forming in milk or the like in case of a feeding bottle teat.

The rough design of the surface in the aforementioned zones makes it seem somewhat softer (gives a softer feel) in these zones as compared to the remaining regions of the teat, where the surface is smooth, and in order to prevent an undesired pressing together or collapsing of the teat in the region of these rough surface zones, it is also advantageous if the rough surface zone is reinforced by at least one stiffening rib. To avoid undesired elevations on the outer side of the teat, it is furthermore preferred if the stiffening rib is provided in the region of the rough surface zone on the inner side of the teat. Also with regard to the preferred extension of the rough surface zone as far as into the nipple, it is suitable if the stiffening rib extends at least partially into the nipple.

Preferably, the nipple has a substantially oval cross-section, whereas the shaft has a circular cross-section. By this, the teat can comfortably be taken into the child's mouth only in two defined positions, and this also has the effect that in this case the rough surface zones can be provided at precisely defined sites on the teat. Accordingly, it is furthermore suitable if two diametrically oppositely located rough surface zones are provided. Moreover, it is advantageously provided the two rough surface zones are located in the region of the flatter sides of the nipple.

In order to allow for a reliable accommodation of the teat in the oral cavity, for designing the teat as a pacifier teat it is advantageous if the teat is configured with a nipple that has a cross-sectional area larger than the cross-sectional area of the shaft.

On the other hand, when designing the teat as a feeding bottle teat, it is suitable for imitating feeding from a mother's breast as closely as possible if the teat is configured with a lip abutment region connecting the shaft and the nipple, the rough surface zone being provided in the lip abutment region.

To simulate the child's sucking at a mother's natural breast, it is furthermore suitable if the wall thickness of the shaft is larger than the wall thickness of the nipple in the lip abutment region and in the region of the nipple. By configuring the teat with differing wall thicknesses, there results a comparatively solid base by the shaft of greater wall thickness that resiliently carries the remaining teat, i.e., the lip abutment region and the following nipple, largely imitating the feel of lying at a mother's natural breast. For, so far, the babies' intake of food via conventional feeding bottle teats has clearly been different from feeding at mother's breast. At a mother's breast, the extremely soft nipple is almost exclusively stripped by the baby's tongue and palate, and since this does not cause any negative pressure (vacuum) in the mother's breast, a completely uniform drinking is possible, in particular, no vacuum or merely a slight vacuum is employed by the baby itself so as to get the milk into his/her mouth and then swallow it. Drinking practically corresponds to drinking from a cup, with an additional stripping.

Conventional feeding bottle teats with relatively high wall strengths are comparatively stiff and hard. Such a stiff feeding bottle teat, however, does not allow for a stripping, whereby the child receives the milk and also the unintended air practically merely by sucking. There, a negative pressure forms within the bottle already with the first sucking, which is counteracted by the baby by producing a stronger vacuum (sucking). This manner of sucking will then have as a consequence that also air is sucked and swallowed from the cavity of the mouth. This air then will lead to the extremely uncomfortable colics which are stressful for mother and child.

Tests have shown that the natural breast of a mother is particularly closely simulated if the shaft substantially has a wall thickness of from 2.00 mm to 2.50 mm, in particular of 2.25 mm, and the nipple and the lip abutment region, respectively, substantially have a wall thickness of from 1.20 mm to 1.50 mm, in particular 1.35 mm.

To facilitate the child's above-described stripping on the teat, it is, moreover, advantageous if within the lip abutment region, at least one zone having a wall thickness lower than the wall thickness of the remaining lip abutment region is provided. Here, again, tests have shown that for the aforementioned stripping by the baby it is particularly advantageous if the zone substantially has a wall thickness of from 1.30 mm to 1.60 mm, in particular 1.45 mm.

If the zone of reduced wall thickness extends as far as into the nipple, the zone of reduced wall thickness is provided in the entire abutment region of the child's mouth or tongue, respectively, thereby further facilitating stripping by the child. There, it is suitable that the zone is substantially triangular in an elevational view. Therefore, in this embodiment, in which the zone of reduced wall thickness extends into the nipple, a combination of at least a lower extent of the nipple and at least an upper extent of the lip abutment region, but not the shaft, can be said to constitute at least one baby-tongue-and-palate-stripping portion of the teat.

In order to avoid an undesired pressing together or collapsing of the teat in the region of the zones of reduced wall thickness, it is suitable if the zone of reduced wall thickness is reinforced by at least one stiffening rib.

To avoid undesired elevations on the outside of the teat, it is preferred if the stiffening rib in the region of the zone of reduced wall thickness is provided on the inner side of the teat.

Particularly in connection with the preferred extension of the zone of reduced wall thickness into the nipple, it is suitable if the stiffening rib extends as far as into the nipple.

If the nipple has a substantially oval cross-section, whereas the shaft has a circular cross-section, the teat can comfortably be taken into the child's mouth only in two defined positions, and consequently the zones of reduced wall thickness can be provided at precisely defined locations on the teat. Accordingly, it is further suitable if two diametrically oppositely located zones of reduced wall thickness are provided. Furthermore, in this connection it is suitable if the two zones of reduced wall thickness are located in the region of the flatter sides of the nipple.

If the rough surface zone and the zone of reduced wall thickness are arranged so as to at least partially overlap, this will result in a partial region of the teat to be formed comparatively yielding and skin-like so that a close imitation of a mother's breast is achieved.

For a particularly close simulation of the surface quality as well as the firmness of a mother's natural breast, it is advantageous if the zone of reduced wall thickness is provided in a partial region of the rough surface zone.

Preferably, the teat is provided as an injection-molded member, with the rough surface zones of the teat being produced by correspondingly rough regions in the injection mold. These rough regions may, e.g., be produced by spark erosion or by chemical etching of the mold surfaces of the injection mold.

Preferably, the teat is made of a thermoplastic elastomer or of silicone, latex, or the like elastomer material.

The teat may also have a nipple of circular cross-section, and in case of a "bent up" so-called "one-sided" configuration of the teat nipple it is also conceivable—with a single correct position within the mouth provided thereby—to provide a rough surface zone on one side only, the lower side of the teat, in the lip abutment region and nipple region.

Nowadays, an essential problem consists in that breastfeeding of the child and, thus, feeding with breast milk for the first 6 months is almost a must for health reasons, on the one hand, yet mothers in many instances cannot breast-feed their children every 4-6 hours because they are not in the child's vicinity, on the other hand. Particularly in the U.S.A., mothers often have to appear on their job again already 6 weeks after having given birth.

Now, mothers try to pump off milk by means of breast pumps, which milk will then be fed to their children in a bottle by someone else, in the mothers' absence. Thus, children must practically switch daily between a feeding bottle teat and a mother's breast, which very often leads to great problems with many of such children who can be of an age of only a few weeks. In most instances, the mother must wean the child and feed the child artificial food. This is absolutely undesirable from a medical viewpoint. American pediatricians even officially recommend breastfeeding of children until their first birthday, giving rise to enormous technical problems, as mentioned above. By providing as small a suction opening in the feeding bottle teat as possible it is being attempted to accustom the child to one and the same suction performance and effort as when sucking on a mother's breast, yet in many instances this has proved to be not enough. Both the "taste" and also the stickiness of rubber or silicone teats is completely different from the feel that the child gets at a mother's breast. Also the manner of sucking milk from a feeding bottle teat is completely different from the drinking movement at a mother's breast.

By the changes in the wall thickness discussed in detail here, the quite essential surface design by roughness, and the special adaptation of these properties, a large step is taken in the direction towards "a mother's breast", and mothers are allowed a substantially longer period of breastfeeding.

The following refer to various particular aspects of the invention that can be provided individually or in various combinations:

A teat according to the invention comprises a shaft and a nipple, the teat being at least partially provided with structured surface areas, wherein the structured surface areas are formed by at least one rough surface zone having a surface roughness of 100 μm at the most.

More particularly, the at least one rough surface zone has a surface roughness of 50 μm at the most.

Still further, particularly, the at least one rough surface zone has a surface roughness of from approximately 10 μm to approximately 40 μm.

And further, more particularly, the at least one rough surface zone has a surface roughness of from 15 μm to 30 μm.

The at least one rough surface zone is substantially triangular in perspective view.

The at least one rough surface zone extends at least partially into the nipple.

Several rough surface zones are provided, and the teat further comprises transparent zones separating the rough surface zones from each other.

The teat further comprises at least one stiffening rib reinforcing the at least one rough surface zone.

The at least one stiffening rib reinforcing the at least one rough surface zone is provided on an inner side of the teat.

The at least one stiffening rib extends at least partially into the nipple.

The nipple has a substantially oval cross section thereby having two flatter sides, and the shaft has a circular cross-section.

The at least one rough surface zone can comprise two rough surface zones that are arranged diametrically opposite each other.

The two rough surface zones are arranged diametrically opposite each other on the two flatter sides of the nipple.

The teat can be designed as a pacifier teat, wherein the nipple has a cross-sectional area and the shaft has a cross-sectional area, the cross-sectional area of the nipple being larger than the cross-sectional area of the shaft.

The teat can be designed as a feeding bottle teat, further comprising a lip abutment region interconnecting the shaft and the nipple, the at least one rough surface zone being provided in the lip abutment region.

The shaft has a certain wall thickness, the lip abutment region has a certain wall thickness, and the nipple has a certain wall thickness, the wall thickness of the shaft exceeding the wall thickness of the lip abutment region and the wall thickness of the nipple.

The wall thickness of the shaft ranges substantially from 2.00 mm to 2.50 mm, and the wall thickness of the nipple and of the lip abutment region substantially ranges from 1.20 mm to 1.50 mm.

The wall thickness of the shaft is substantially 2.25 mm.

The wall thickness of the nipple and the wall thickness of the lip abutment region is substantially 1.35 mm.

The lip abutment region comprises at least one thinner zone having a wall thickness slighter than the wall thickness of the remaining lip abutment region.

The at least one thinner zone has a wall thickness ranging substantially from 1.30 mm to 1.60 mm.

The wall thickness of the at least one thinner zone is 1.45 mm.

The at least one thinner zone extends as far as into the nipple.

The at least one thinner zone is substantially triangular in perspective view.

The at least one thinner zone is reinforced by at least one stiffening rib.

The at least one stiffening rib provided in the thinner zone is located inside the teat.

The at least one thinner zone can comprise two thinner zones that are provided diametrically opposite each other.

The nipple has a substantially oval cross section, thereby having two flatter sides, and the shaft has a circular cross-section, the two thinner zones being provided on the flatter sides of the nipple.

The at least one rough surface zone and the at least one thinner zone are arranged so as to at least partially overlap.

The at least one thinner zone is provided in a partial region of the at least one rough surface zone.

As a pacifier, the teat further comprises a lip abutment region interconnecting the shaft and the nipple, the at least one rough surface zone being provided in the lip abutment region, and the shaft being thicker than the lip abutment region and thicker than the nipple, the lip abutment region including at least one thinner zone having a wall thickness slighter than the wall thickness of the remaining lip abutment region, the thinner zone being provided in a partial region of the at least one rough surface zone.

A teat according to the invention is an injection-molded teat.

A teat according to the invention is made of a thermoplastic elastomer.

A teat according to the invention is made of a material selected from the group consisting of latex, silicone and the like elastomer materials.

BRIEF DESCRIPTION OF THE DRAWINGS

In the following description, the invention is explained in more detail by way of preferred exemplary embodiments illustrated in the drawings to which, however, the invention shall not be restricted. In detail, in the drawings.

DETAILED DESCRIPTION

Figure 2:
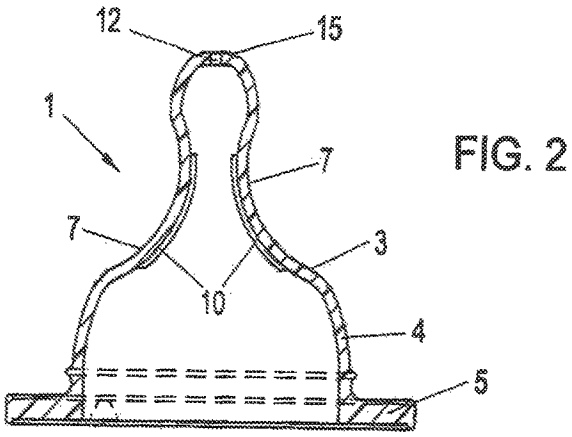
FIG. 2 shows a view of the feeding bottle teat according to FIG. 1.
Figure 3:
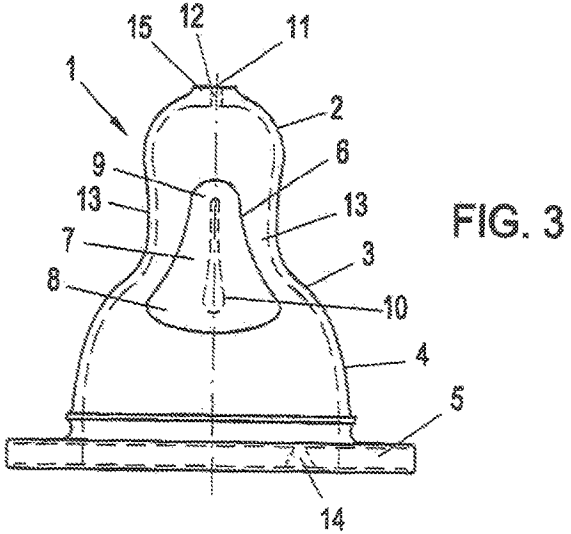
FIG. 3 shows a schematic longitudinal section through the feeding bottle teat according to FIGS. 1 and 2.
Figure 1:
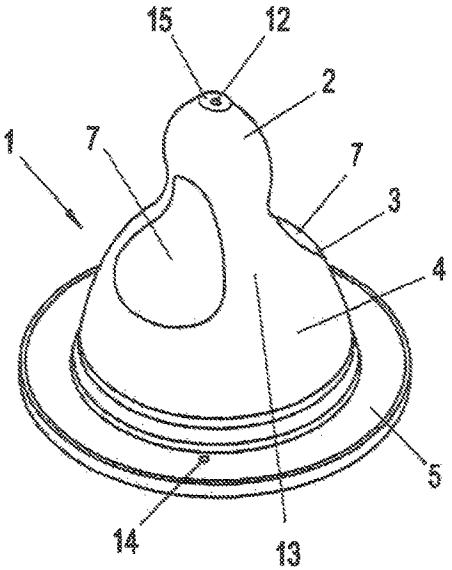
FIG. 1 shows a perspective view of a feeding bottle teat according to the invention.

In FIGS. 1 to 3, a teat 1 in the form of a feeding bottle teat presently considered as most preferred embodiment is shown which in a per se conventional manner comprises a nipple 2, a consecutive lip abutment region 3 which merges continuously into a shaft 4 and, finally, a teat flange 5 for clamping the teat 1 on a bottle neck of a feeding bottle with the help of a screw cap, as is well known per se and not illustrated. As shown in FIG. 2, for example, the teat 1 includes an outer surface extending downwardly within the nipple 2 through an outer concave region, and through an outer convex region. In the region of the shaft 4 and the flange 5, the teat 1 has a rotation-symmetrical design, i.e., its cross-section is circular, yet the nipple 2 has an oval cross-section so that it can be comfortably taken into the infant's mouth in two positions only, i.e., with the longer axis in transverse direction. In the lip-abutment region 3, the cross-sectional shape continuously merges from the oval shape of the nipple 2 into the circular shape of the shaft 4.

On the two wide sides of the teat 1, i.e., at the two sides that extend in parallel to the longer axis of the oval cross-section of nipple 2, diametrically opposite structured (textured) surface areas 6 in the form of rough surface zones 7 are provided. Seen in elevational view, as in FIG. 3, these rough surface zones 7 are approximately triangular, and they are provided such that their wider base region 8 is in the lip abutment region 3 and their narrower tip region 9 extends upwardly as far as to half of the nipple 2 and within at least the aforementioned concave region of the nipple.

At the inner side of teat 1, in the region of the rough surface zones 7, i.e., the opposing surface textured areas 6, stiffening ribs 10 are located which, according to a central plane 11 of teat 1, extend from bottom to top and enhance the strength of the teat 1 in the region of the rough surface zones 7. This is advantageous because on account of the surface roughness in zones 7, the softness of the teat 1 increases so that—also when using an appropriately soft material for teat 1—the teat 1 could unintentionally become extremely depressed in this lip abutment region 3 when the teat 1 is used. That is, these textured surface zones 7, that is, the so-called baby-tongue-and-palate-stripping portions of the teat are soft zones that simulate the corresponding areas of a mother's breast.

Preferably, the surface roughness of the textured zones is approximately 100 μm at the most or, in particular 50 μm at the most, and tests have shown that optimum roughness depths range between 10 μm and 40 μm, preferably between 15 μm and 30 μm. Such values for the roughness depths result in an optimum imitation of a mother's breast.

When producing the teat 1, these surface roughnesses are obtained, e.g., during injection molding, in that the mold used during the production, in particular an injection mold, is surface-roughened by spark erosion or by chemical etching at the respective areas where the zones 7 are produced.

By the triangular shape of the zones 7 with the triangle tip pointing towards the tip of the teat, where a feeding opening 12 is provided in a conventional manner, it is ensured that, during drinking, also the infant's tongue will come into contact with the roughened zone 7, which is similar to a mother's breast, and is stimulated thereby.

As mentioned above, the area in question of the teat is stiffened by the stiffening ribs 10 so that it cannot "collapse" during drinking and thereby cannot block the continued flow of the drinking liquid, in particular milk.

For hygiene purposes, not the entire surface of the teat is roughened, much rather, as illustrated, preferably two diametrically oppositely located rough surface zones 7 are provided, and at least in the regions 13 between these rough surface zones 7, preferably in the entire remaining region of the teat 1 outside of the rough surface zones 7, the teat 1 is designed to be transparent, having a smooth surface, so that soilings, the formation of lumps and the like will immediately be visible from the outside.

Accordingly, a thermoplastic elastomer or a latex or silicone material is preferably used as the material for the teat 1, which is translucent or transparent and which is also suitable for a production by injection molding.

Figure 4:
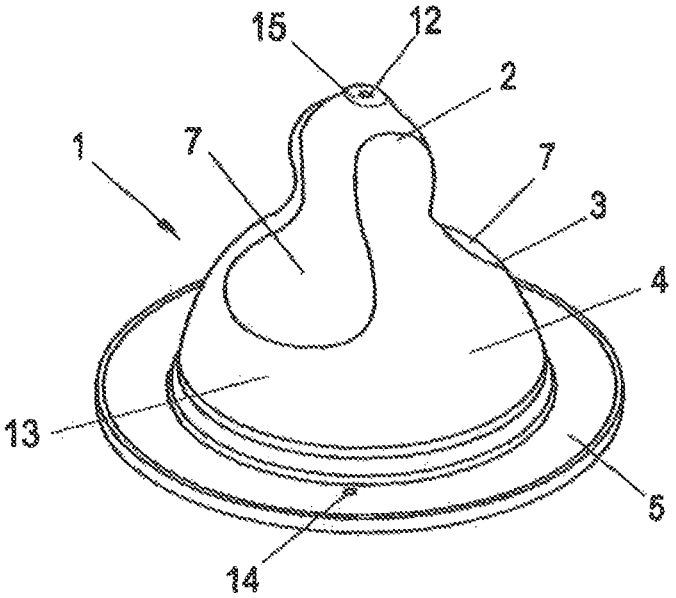
FIG. 4 shows a perspective view of another feeding bottle teat according to the invention.
Figure 5:
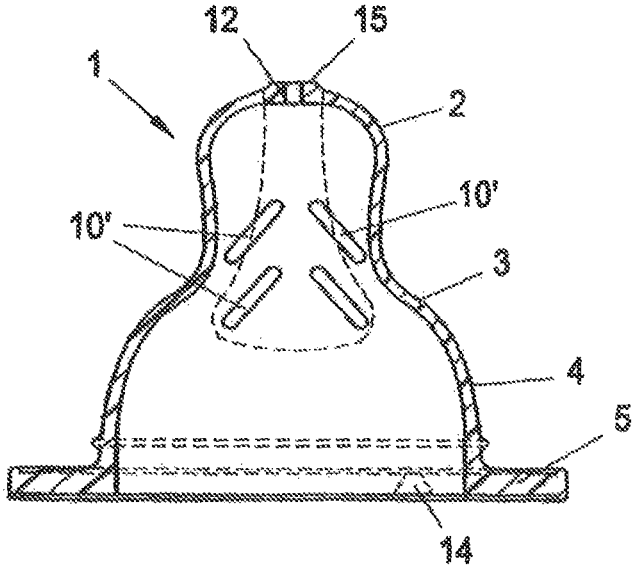
FIG. 5 shows a schematic section through the feeding bottle teat according to FIG. 4, illustrating an inclined arrangement of stiffening ribs in the interior of the feeding bottle teat.

In FIGS. 4 and 5, a somewhat modified teat 1 in the form of a feeding bottle teat is illustrated, which also comprises a nipple 2, a lip abutment region 3, a shaft 4 and a teat flange 5, wherein again the teat 1 is provided with rough surface zones 7 on two diametrically opposite sides, the flatter sides or broadsides of the teat 1 in relation to the longer axis of the nipple 2 which, again, is oval in cross-section. In the remaining region 13, the teat again is designed to be transparent or translucent and smooth. However, in contrast to the exemplary embodiment according to FIGS. 1 to 3, in the embodiment according to FIGS. 4 and 5 the aforementioned structured surface areas (such as areas 6, 6 of FIGS. 1-3) are formed by one continuous rough surface (that is, textured surface) region or zone 7-7 that extends over the upper side of the nipple 2. Thus, it can be said that the textured surface 7-7 that make up the structured surfaces areas 6, 6 extend within and above the concave outer surface of the nipple 2, as well as within the convex outer surface at the upper extent of the nipple. Furthermore, FIG. 5 shows that 2×2 reinforcing ribs 10' are obliquely arranged on the inner side of the teat 1 so as to again avoid an undesired collapsing or pressing together of the teat 1 in this critical region of the transition from nipple 2 to shaft 4.

Also, the teat 1 according to FIGS. 4 and 5 may be produced from the materials previously mentioned in connection with the teat 1 according to FIGS. 1 to 3 and in a comparable injection molding process, using a mold with zones corresponding to the zones 7, roughened by spark erosion or by chemical etching, and the surface roughness in zones 7 again is 100 μm at the most, in particular 50 μm at the most, 10 μm to 40 μm, and preferably between 15 μm and 30 μm.

From the illustrations of FIGS. 1, 2, as well as FIG. 5, it is further visible that a per se conventional venting opening 14 may be provided in the region of the teat flange 5 so as to allow for a pressure equalization in the bottle interior during drinking by letting in air.

Furthermore, the teat 1 may be reinforced in the region of the drinking opening 12 by thickened portions 15 on the outer side as well as on the inner side so as to ensure an increased strength on the front side of nipple 2, which is advantageous for drinking.

Figure 6:
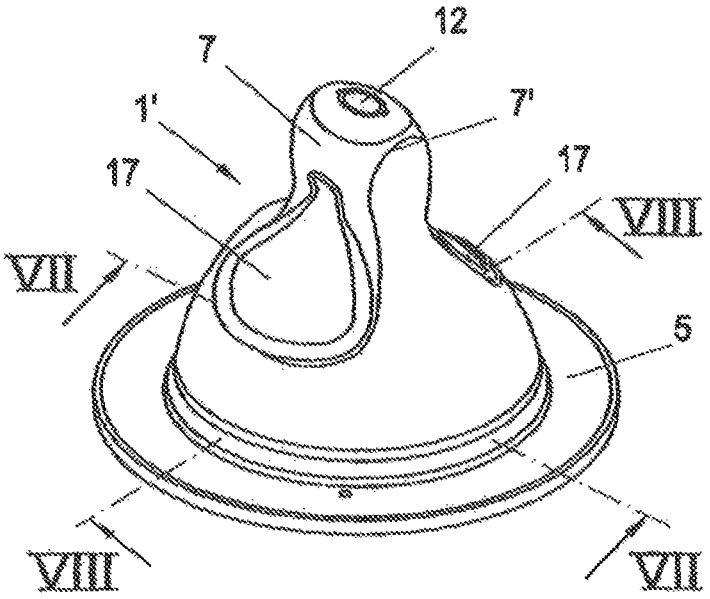
FIG. 6 shows a perspective view of a feeding bottle teat having a zone of reduced wall thickness.
Figure 7:
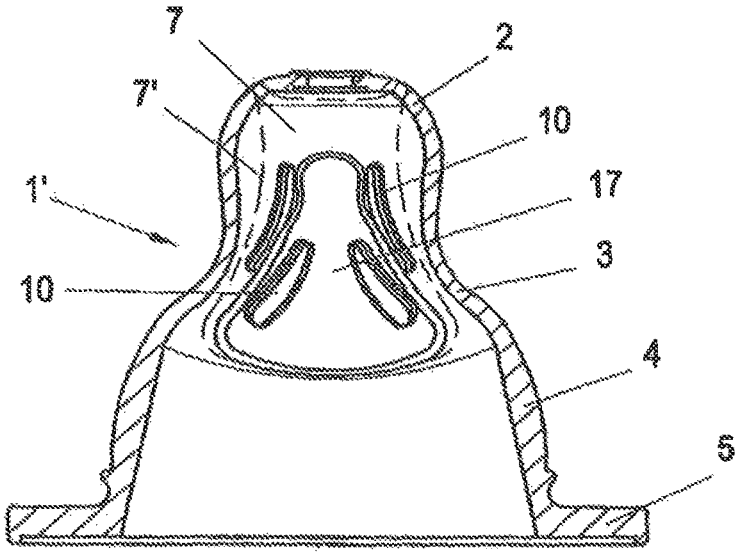
FIG. 7 shows a section according to line of FIG. 6.
Figure 8:
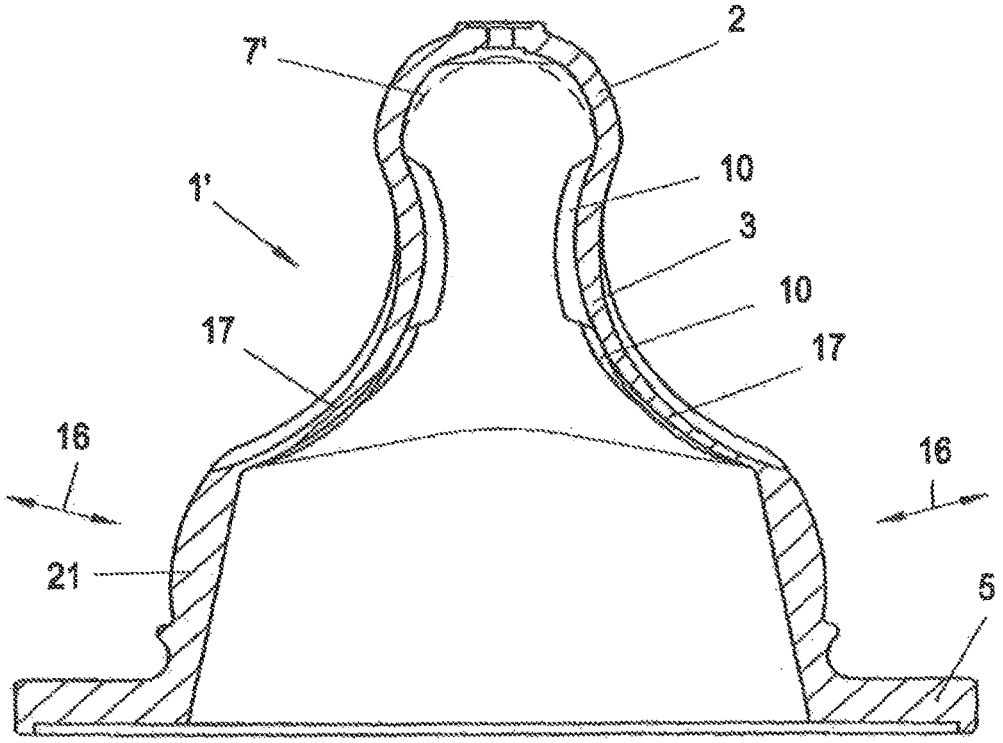
FIG. 8 shows a section according to line of FIG. 6.

In FIGS. 6 to 8, an alternative exemplary embodiment of a bottle teat 1' is illustrated, in which the shaft 4 of the bottle teat 1' has a greater wall thickness than the following lip abutment region 3 as well as an adjacent nipple 2. This results in a resilience force of the shaft 4 acting in the direction of arrow 16 (cf. FIG. 8), which shaft carries the lip abutment region 3 as well as the nipple 2 of lower wall strength, said resilience allowing for a so-called stripping by the child, which is a good imitation of sucking at mother's breast.

To further facilitate this stripping by the child and to simulate sucking at a mother's breast, two zones 17 are provided in the lip abutment region 3 which zones—as is particularly visible in FIG. 8—have a further thinned wall thickness as compared to the remaining lip abutment region.

Just as the previously described teat 1 of uniform wall thickness, teat 1' is rotation-symmetrically designed in the region of its shaft 3, i.e., its cross-section is circular, and the nipple 2 is oval in cross-section so that it can be comfortably correctly taken into the mouth by an infant in two positions only, i.e., with the longer axis in transverse direction. In the lip abutment region 3, the cross-sectional shape merges from the oval shape of the nipple 2 into the circular shape of shaft 4, whereby the shape of the nipple 2 corresponds to the natural shape of the mammilla as closely as possible, while a baby sucks or strips at the mammilla.

Here, the two zones 17 of reduced wall thickness are arranged to be diametrically oppositely located at the two broadsides of the teat 1', i.e. at those sides which extend in parallel to the longer axis of the oval cross-section of the nipple 2, and they are designed to be approximately triangular in elevational view so that they will extend with their broad basis region in the lip abutment region 3 and with their narrower tip region as far as into the nipple 2.

On the inner side of each zone 17, four stiffening ribs 10 are provided so as to enhance the strength of teat 1', in particular in the zones 17 of reduced wall thickness, so that there will be no unintentionally strong pressing in of the teat 1' in the lip abutment region 3 even when soft materials are used for teat 1'. Thus, a collapsing of the teat 1' by which the continuous flow of drinking liquid, in particular milk, would be blocked, is reliably prevented by the stiffening ribs 10.

Moreover, the surface of teat 1' has an increased surface roughness on the lip abutment region 3 as well as on the nipple 2 as compared to the remaining teat 9 so that the nature of a mother's breast can better be simulated.

In the teat 1' shown in FIGS. 6 to 8, a zone 7 which is surrounded by the contour line 7' is provided with the increased surface roughness previously described in detail of approximately 100 μm at the most or, in particular 50 μm at the most.

Figure 11:
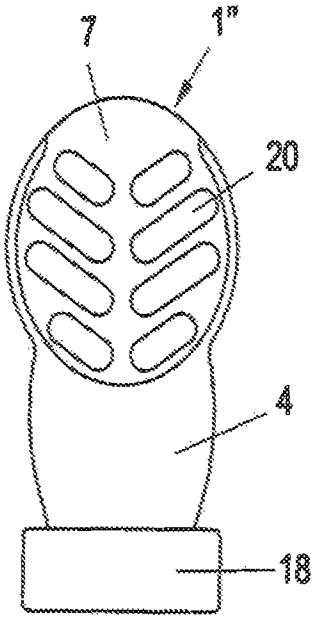
FIG. 11 shows a rear view of the pacifier teat according to FIG. 9.
Figure 10:
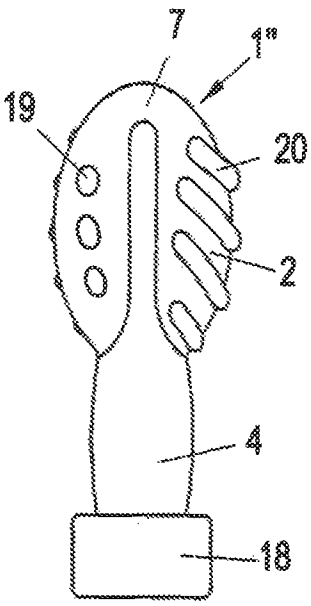
FIG. 10 shows a side view of the pacifier teat according to FIG. 9.
Figure 9:
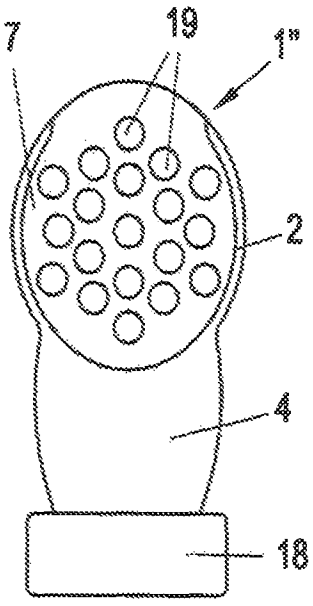
FIG. 9 shows a view of a pacifier teat with a rough surface zone in the region of the nipple.

In FIGS. 9 to 11, a pacifier teat 1" is shown as a further exemplary embodiment, in which the shaft 4 as well as the nipple 2 are designed to be oval in cross-section, with the nipple 2, however, having a larger cross-section than shaft 4 for a good accommodation in the oral cavity. At the end side, a flange 18 of larger cross-section follows shaft 4 for fastening the pacifier teat 1" in a pacifier shield (not illustrated).

For as close an imitation as possible of sucking on a mother's breast, also the pacifier nipple 1" has a rough surface zone 7 provided in the region of nipple 2, which will be contacted by the baby's tongue in the functional position of the pacifier teat 1" received in the baby's mouth. In the pacifier teat 1", the rough surface zone 7 mainly extends on the diametrically oppositely located broadsides of nipple 2.

Furthermore, to imitate the natural breast of a mother, raised areas are provided on the broadsides of nipple 2 in the rough surface zone 7. In the exemplary embodiments illustrated in FIGS. 9 to 11, round nodules 19 are provided as raised areas on one broadside of nipple 2, on the other broadside fishbone-type arranged ribs 20 are provided. What is essential here, too, is mainly that a rough surface, skin like zone 7, is provided to simulate the surface quality of the natural breast of a mother.

Figure 12:
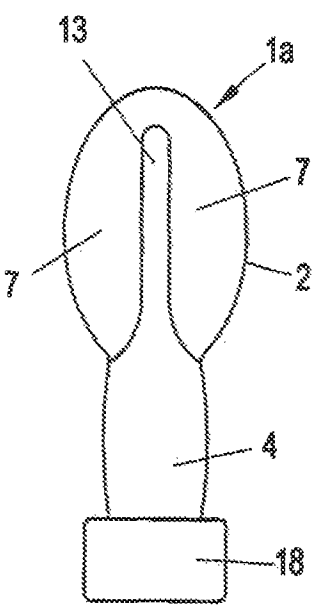
FIG. 12 shows a side view of a further pacifier teat with a rough surface zone.

In FIG. 12, finally, a pacifier teat 1*a* is shown in a side view similar to FIG. 10, with a nipple 2 without raised areas, which in turn merges into a flange 18 via a shaft 4, and which has a rough surface zone 7 on both broadsides as well as on its tip; on the two narrow sides as well as on shaft 4, smooth, transparent regions 13 are provided.

The invention claimed is:

1. A teat comprising:

a nipple adapted to be received within a baby's mouth; shaft; and a lip abutment region interconnecting the shaft and the nipple;

the nipple comprising a concave outer surface extending around a circumference of the nipple;

the lip abutment region comprising a convex outer surface extending around a circumference of the lip abutment region;

structured surface areas configured to be contacted by the baby's mouth, said structured surface areas formed by at least one textured surface;

the at least one textured surface extending continuously within and above the concave outer surface on a first side of the nipple and upwardly and over an upper side of the nipple, and down into a second opposite side of the concave outer surface of the nipple;

at least a portion of an outer surface of the teat having a smooth surface, the smooth surface being other than a textured surface; and wherein a horizontal cross section of the teat passes through both the structured surface areas and the smooth surface.

2. A teat according to claim 1, wherein:

the smooth surface is a non-textured surface and has a stickiness.

3. A teat according to claim 2, wherein:

the non-textured surface is a transparent or translucent surface.

4. A teat according to claim 1, wherein:

the at least one textured surface extends within the outer convex surface of the lip abutment region.

5. A teat according to claim 4, wherein:

the outer convex surface of the lip abutment region does not include any outwardly projecting nodules.

6. A teat according to claim 1, wherein:

the teat is an injection-molded teat.

7. A teat according to claim 1, wherein:

the teat is made of an elastomer and the smooth surface has a stickiness.

8. A teat according to claim 7, wherein:

the elastomer is latex.

9. A teat according to claim 7, wherein:

the elastomer is silicone.

10. A teat according to claim 1, wherein:

the at least one textured surface extends within the lip abutment region.

11. A teat according to claim 10, wherein:

the shaft has a certain wall thickness, the lip abutment region has a certain wall thickness, and the nipple has a certain wall thickness; and the wall thickness of the shaft exceeds the wall thickness of the lip abutment region and the wall thickness of the nipple.

12. A teat according to claim 11, wherein:

the wall thickness of the shaft ranges from 2.00 mm to 2.5 mm; and the wall thickness of the nipple and of the lip abutment region ranges from 1.20 mm to 1.50 mm.

13. A teat according to claim 11, wherein:

the lip abutment region comprises at least one thinner zone having a wall thickness slighter than the wall thickness of a remaining lip abutment region.

14. A teat according to claim 13, wherein:

the at least one thinner zone extends into the portion of the concave outer surface of the nipple; and the at least one textured surface and the at least one thinner zone are arranged so as to at least partially overlap.

15. A teat according to claim 14, wherein:

the at least one thinner zone is reinforced by at least one stiffening rib inside the teat.

16. A teat according to claim 1, wherein:

the at least one textured surface comprises a surface formed by having been molded from a mold having been surface-roughened by spark erosion or chemical etching.

17. A teat according to claim 1, wherein:

the at least one textured surface has a surface roughness within a range of 10 μm to 50 μm.

18. A teat according to claim 1, further comprising:

at least one stiffening projection in the form of a rib provided on an inner side of the teat configured to reinforce the at least one textured surface at least in an area of the nipple.

19. A teat according to claim 18, wherein:

on an outer surface of none of the at least one textured surface is there a projection having an elevation as great as an elevation of a stiffening projection of the rib.

20. A teat comprising:

a nipple having a circumferentially extending concave outer surface;

a lip abutment region below the nipple;

a shaft below the lip abutment region;

the lip abutment region extending continuously into the shaft;

at least one rough surface zone having a roughness depth of 10 μm to 50 μm;

at least one smooth surface zone having a stickiness;

the at least one rough surface zone having a greater roughness depth than a roughness depth of the at least one smooth surface zone;

the at least one rough surface zone having a soft, skin-like appearance and feel and a lesser stickiness than the stickiness of the at least one smooth surface zone;

the teat being transparent or translucent in the at least one smooth surface zone;

the at least one rough surface zone extending above the lip abutment region and continuously within a length of the nipple within and above the concave outer surface on a first side of the nipple and upwardly and over an upper side of the nipple, and down into a second opposite side of the concave outer surface of the nipple to configure the at least one rough surface zone to be positioned to be contacted by a baby's tongue during a feeding or sucking position of the nipple received in a baby's mouth; and wherein a horizontal cross section of the teat passes through both the structured surface areas and the smooth surface.

21. A teat according to claim 20, wherein:

the teat is made of a material selected from the group consisting of a rubber or silicone that provides the at least one smooth surface zone with the stickiness; and the roughness depth of the at least one rough surface zone provides the teat, in the at least one textured zone, with a greater softness and the lesser stickiness than in the at least one smooth surface zone.

22. A teat according to claim 20, wherein:

the lip abutment region comprises an outer convex surface; and the at least one textured surface extends within the outer convex surface of the lip abutment region and at least within the outer concave surface of a lower region of the nipple.

23. A teat according to claim 20, wherein:

a combination of at least a lower extent of the nipple and at least an upper extent of the lip abutment region, but not the shaft, constitute at least one baby-tongue-and-palate-stripping portion of the teat; and said at least one rough surface zone consists of said at least one baby-mouth-and-palate-stripping portion of the teat.

24. A teat according to claim 23, wherein:

said at least one baby-tongue-and-palate-stripping portion of the teat comprises at least two baby-tongue-and-palate-stripping portions of the teat arranged diametrically opposite each other.

25. A teat according to claim 23, wherein:

said at least one baby-tongue-and-palate-stripping portion of the teat is substantially triangular.

* * * * *